US008230526B2

(12) United States Patent
Holland et al.

(10) Patent No.: US 8,230,526 B2
(45) Date of Patent: Jul. 31, 2012

(54) GARMENT

(76) Inventors: Guyon Holland, Leichardt (AU); Sean Ashby, Leichardt (AU)

( * ) Notice: Subject to any disclaimer, the term of this patent is extended or adjusted under 35 U.S.C. 154(b) by 149 days.

(21) Appl. No.: 12/445,214

(22) PCT Filed: Oct. 5, 2007

(86) PCT No.: PCT/AU2007/001509

§ 371 (c)(1),
(2), (4) Date: Apr. 29, 2009

(87) PCT Pub. No.: WO2008/043130

PCT Pub. Date: Apr. 17, 2008

(65) Prior Publication Data

US 2010/0005561 A1 Jan. 14, 2010

(30) Foreign Application Priority Data

Oct. 11, 2006 (AU) ..... 2006905638

(51) Int. Cl.
*A41B 9/00* (2006.01)

(52) U.S. Cl. ..... 2/403; 2/400

(58) Field of Classification Search ..... 2/400–405, 2/67, 227, 228, 238; 602/67
See application file for complete search history.

(56) References Cited

U.S. PATENT DOCUMENTS

| | | | | |
|---|---|---|---|---|
| 2,621,654 | A * | 12/1952 | Wallace, Sr. | 602/67 |
| 2,822,807 | A * | 2/1958 | Heyman | 602/67 |
| 3,459,181 | A * | 8/1969 | Mann | 602/67 |
| 3,621,846 | A * | 11/1971 | Lehman | 2/67 |
| 4,955,088 | A * | 9/1990 | Terjesen | 2/403 |
| 5,070,869 | A * | 12/1991 | Zhang | 602/67 |
| 5,524,298 | A * | 6/1996 | Plunkett | 2/403 |
| 7,017,193 | B2 | 3/2006 | Auger | |
| 7,676,853 | B1 * | 3/2010 | Cutlip | 2/403 |
| 2006/0162052 | A1 * | 7/2006 | Stankowski et al. | 2/403 |
| 2008/0109945 | A1 * | 5/2008 | Xia | 2/403 |

FOREIGN PATENT DOCUMENTS

| | | |
|---|---|---|
| EP | 0448772 B1 | 10/1991 |
| FR | 2841439 A1 | 1/2004 |

* cited by examiner

*Primary Examiner* — Katherine M. Moran
*Assistant Examiner* — Rachale Quinn
(74) *Attorney, Agent, or Firm* — Knobbe Martens Olson & Bear LLP

(57) ABSTRACT

The present invention relates generally to male garments. In particular, the present invention provides a men's underwear or swimwear garment for supporting the male genitals, the garment including a double-layered front portion having an inner layer and an outer layer, wherein a lower portion of the inner layer of the double-layered front portion is folded upward to form a pouch in the interior of the garment, wherein, in use, the pouch engages with the genitals of the male wearer to displace the genitals of a male wearer forward and/or upward.

9 Claims, 3 Drawing Sheets

GARMENT

RELATED APPLICATIONS

This application is a U.S. National Phase of International Application No. PCT/AU2007/001509, filed Oct. 5, 2007, designating the U.S. and published in English on Apr. 17, 2008 as WO 2008/043130, which claims the benefit of Australian provisional patent application 2006905638, filed Oct. 11, 2006, the contents of which are herein incorporated by reference.

FIELD OF THE INVENTION

The present invention relates generally to male garments. In particular, the present invention relates to male garments for supporting and enhancing the appearance of the male genitals.

BACKGROUND OF THE INVENTION

The literature is replete with designs of men's underwear that attempt to enhance, displace or reshape the male genitals. Many such prior art designs surround or envelop the entire male genitals. Some may be difficult to don; others may be painful to wear, and others still may be bizarre in appearance. All of them generally attempt to recreate the appearance of the natural lines and contours of the genitals with their own particular design.

One category of these prior art designs has a front panel which covers the male genitals, and sometimes provides a small amount of material to act as a single-pouch support for holding the male genitals. Such front genital covers are then integrated into underwear, and are held to the body by an included waistband. An example of this first category can be seen in U.S. Pat. No. 5,157,793 which discloses an oval-shaped hole in the crotch panel of the underwear and a dome-shaped single-pouch which is attached at the hole periphery. Basically designed to deform the genitals, this pouch, in use, has been found to cause varying degrees of discomfort.

Another category uses either flaps, channels, bags, pockets, holes, or slots for wrangling, hanging, suspending, or guiding the penis into some structure for containing the scrotum. These mechanisms create an unnatural, and often painful, separation of the penis from the scrotum. An example of this second category is disclosed in U.S. Design Pat. No. 268,964, which provides a construction for surgical or medical applications and this is not intended to provide comfort.

Another category includes protective devices structured to merely cover the male genitals. These devices are held in place by conventional briefs or athletic supporters that may be worn over them, making them cumbersome since they must be retained by an additional article of clothing. Moreover, none of the designs in this category cover the genitals in a manner that retains their natural shape but, rather, each causes an unnatural reshaping to be imposed upon the genitals. They are thus generally uncomfortable to wear. A typical structure of this third category is disclosed, for example, in U.S. Pat. No. 4,731,063.

Another category relates to decorative and protective devices which are designed to cover only the crotch area of the wearer, whether the scrotum or the penis or both. These devices are held in place by means which either bind about the base circumference of the male genitals or use a wire retainer that extends from the front crotch area to the rear between the buttocks. In U.S. Pat. No. 5,467,482, for example, a decorative device is configured with a flat fabric suspended by a wire frame that does not hold the genitals. Such a construction is inherently uncomfortable and, at best, will cause the wearer's genitals to be exposed from the top, bottom and sides and, at most, will permit the genitals to fall out the bottom, exposing them.

As a rule, the above prior art designs disturb and distort the shape of the genitals and, in general, are needlessly complex. This complexity both increases the difficulty and discomfort associated with the use of the prior art designs and adds to their manufacturing cost relative to conventional undergarments.

Accordingly, a need exists for a garment that lifts the male genitals so as to prominently expose their shape without, however, providing significant discomfort to the wearer. Furthermore, a need also exists for such a garment which is not significantly more difficult or significantly more expensive to manufacture than conventional garments.

Before turning to a summary of the invention, it must be appreciated that the above description of the prior art has been provided merely as background to explain the context of the invention. Accordingly, reference to any prior art in this specification is not, and should not be taken as, an acknowledgment or any form of suggestion that this prior art is known or forms part of the common general knowledge in any country.

SUMMARY OF THE INVENTION

The present invention provides a men's underwear or swimwear garment for supporting the male genitals, the garment including a double-layered front portion, having an inner layer and an outer layer, wherein a lower portion of the inner layer of the double-layered front portion is folded upward to form a pouch in the interior of the garment, wherein, in use, the pouch engages with the genitals of the male wearer to displace the genitals of a male wearer forward and/or upward.

The formation of a pouch in accordance with the present invention provides a means for displacing the genitals of a male wearer forward and/or upward while ameliorating the need for excess extra seams, pockets, slings or the like being added to the garment. Thus the garment of the present invention provides a support that lifts a male's genitals so as to prominently expose them without, however, providing significant discomfort to the wearer. Furthermore, the garment of the present invention is not substantially more difficult or expensive to manufacture relative to existing underwear or swimwear garments.

Throughout this specification, spatial terms such as "upward", "forward", "upper", "lower" and "top" and the like will be used. It should be appreciated that these terms are used for ease of reference and relate to the normal orientation of the garment of the invention when being worn by an upright (standing) male user.

Also, as referred to herein a "a men's underwear or swimwear garment for supporting the male genitals" refers to any style of underwear or swimwear which supports and/or covers the male genitals and includes, for example, briefs, square-cut briefs, hipster briefs, sports briefs, thongs or g-strings, athletic supporters, swimming trunks and the like. Such garments including a "double-layered front portion" are known in the art. In known men's underwear or swimwear garments including a double-layered front portion, the double-layered front portion typically extends from a waistband of the garment, over the genitals of the wearer, to a region of the garment which is proximate to the perineum of the wearer. In general, these garments comprise two layers of material (an inner layer and an outer layer) over at least the front portion of the garment, including the region covering the genitals of the wearer.

The present invention differs from known underwear or swimwear garments including a double-layered front portion in that the present invention contemplates the formation of a pouch in the interior of the garment. In the present invention, the pouch is formed by folding a lower portion of the inner layer of the double-layered front portion laterally upward. In one embodiment, the formation of the pouch involves folding the inner layer such that the end of the inner layer which is ordinarily proximate the perineum of the wearer is folded upward and secured to form a top-opening pouch.

As set out above, the pouch formed in the garment of the present invention is adapted to engage with the genitals of the wearer and thus displace the genitals forward and/or upward. The term "engagement" as used herein includes any contact between the pouch and the genitals to effect forward and/or upward displacement. In one embodiment, engagement includes the pouch receiving all or part of the genitals of the wearer.

In another embodiment of the present invention, the genitals of a male wearer automatically engage with the pouch as the garment is put on by the wearer, without the need for manual handling of the genitals to effect engagement with the pouch. In one embodiment, this may be effected by the engagement of the free edge or lip of the pouch with the posterior region of the male genitals as the garment is put on by the wearer.

As the garment of the present invention is adapted to forwardly and/or upwardly displace the genitals of a male wearer, the front portion of the garment (both the inner and outer layers) is preferably shaped and/or constructed to accommodate the forwardly and/or upwardly displaced genitals of a male wearer.

BRIEF DESCRIPTION OF THE FIGURES

Having briefly described the general concepts involved with the present invention, an exemplary preferred embodiment of the garment of the present invention will now be described with reference to the following figures.

DESCRIPTION OF THE PREFERRED EMBODIMENTS

It is to be understood that the following description is for the purpose of describing particular embodiments only, and is not intended to be limiting with respect to the above description.

Figure 1:
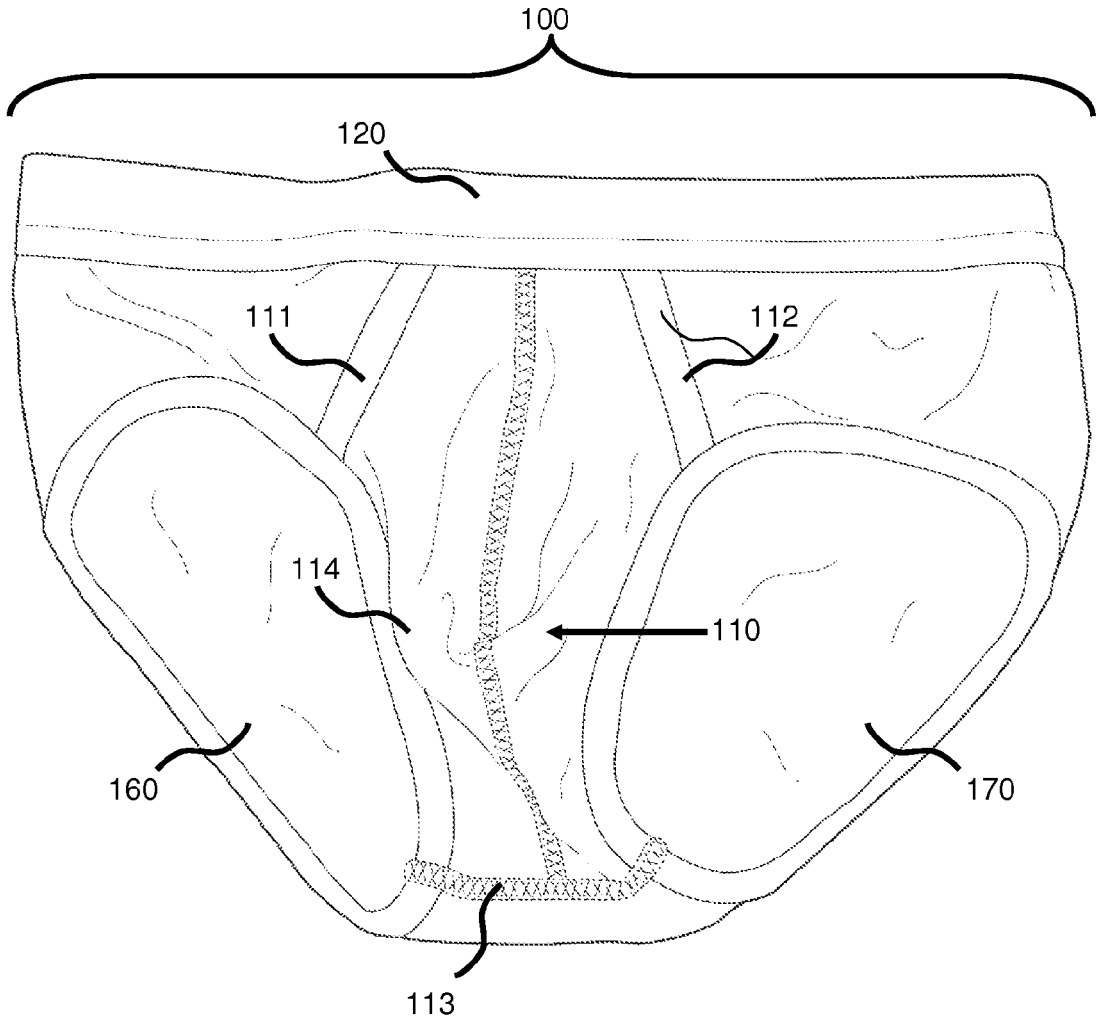
FIG. 1 shows a right-way-out view of the front of a garment according to a preferred embodiment of the present invention.
Figure 2:
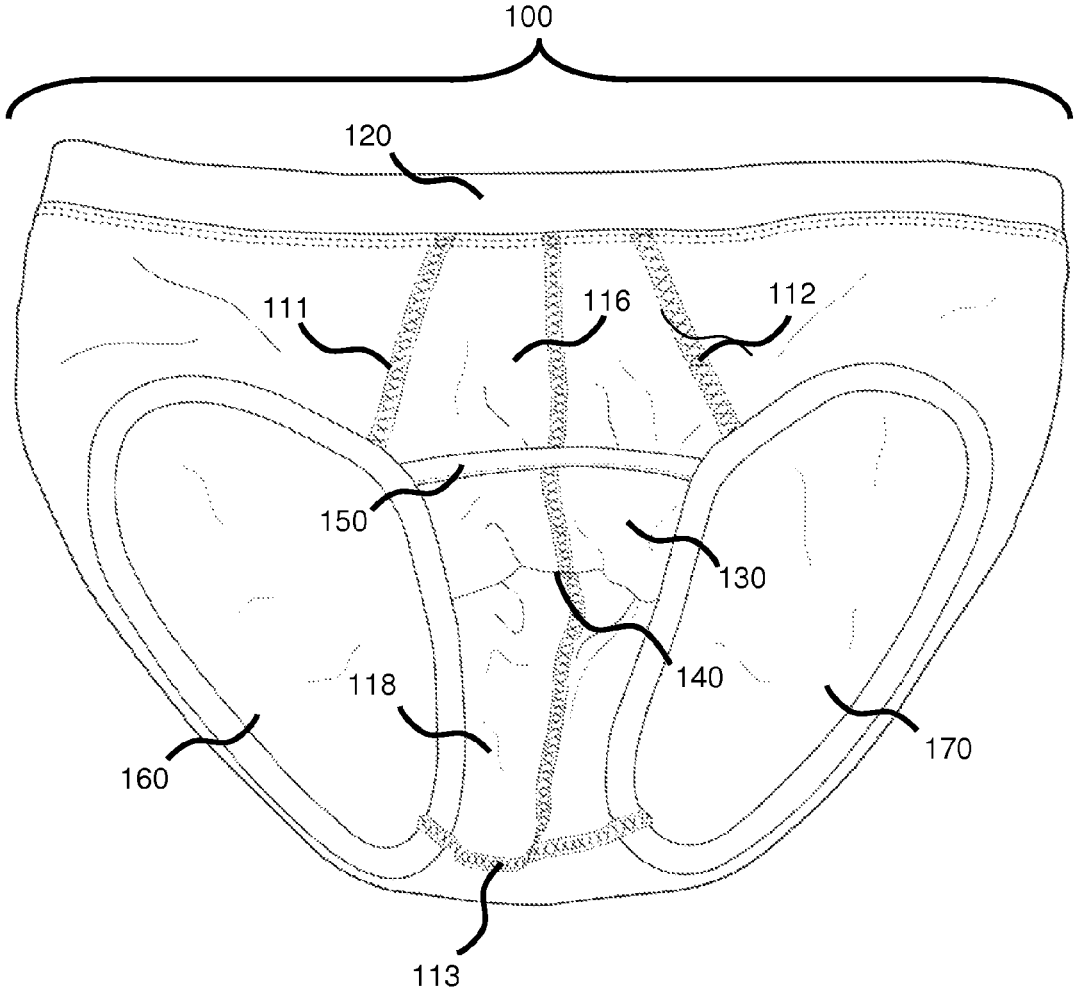
FIG. 2 shows an inside-out view of the front of the garment shown in FIG. 1.
Figure 3:
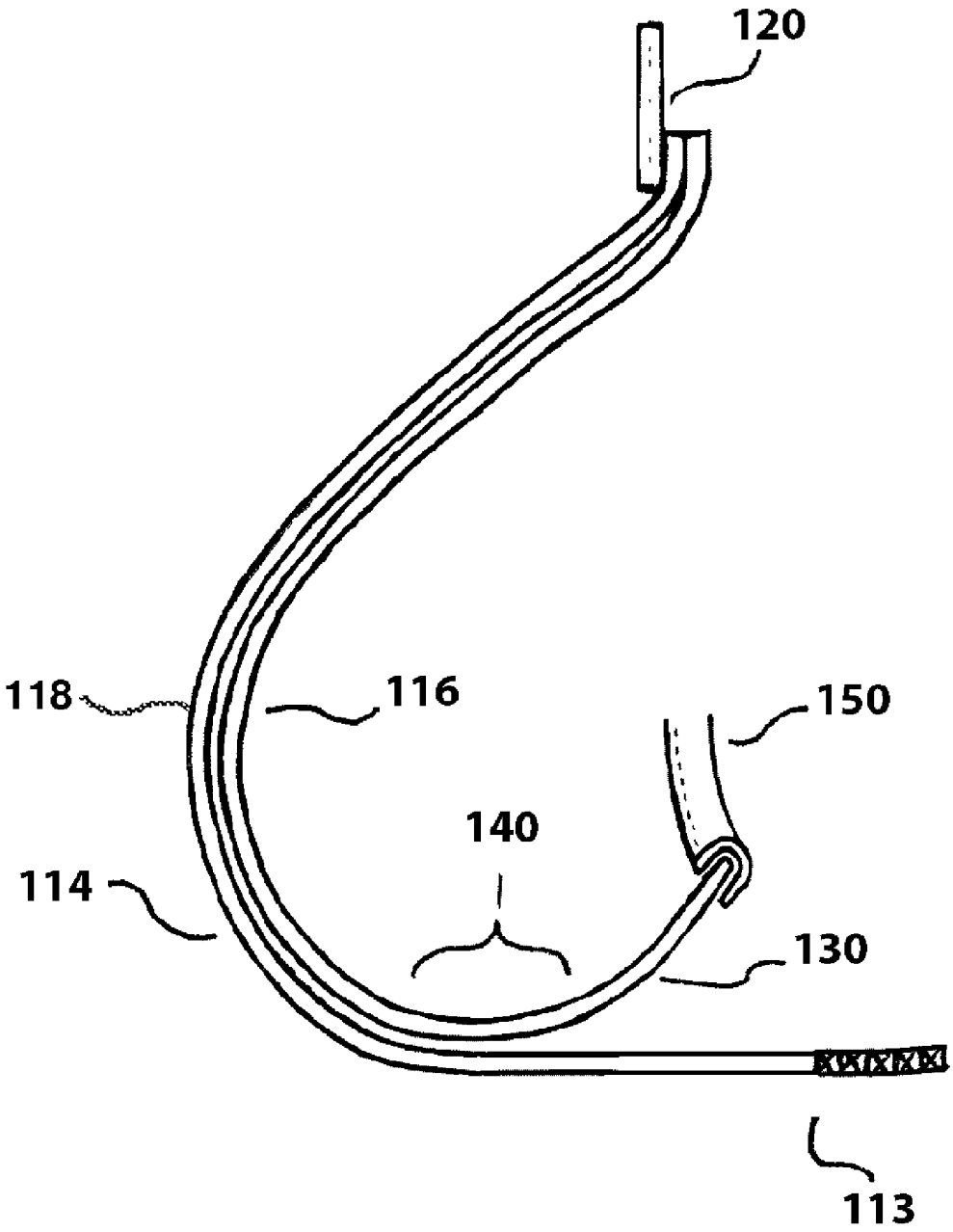
FIG. 3 shows a cross section of the front part of the garment as shown in FIG. 1.

The garment shown in FIGS. 1 and 2 allows the wearer of the garment 100 to displace his genitals forward and upward within the garment to provide the impression of having larger and more prominent genitals than that user would otherwise appear to have.

Referring to FIG. 1, the garment 100 is a men's brief that includes a double-layered front portion 110. The front portion 110 covers the region delimited by (clockwise from the top) waistband 120, stitching 112, leg opening 170, stitching 113 (which is proximate to the perineum of the wearer), leg opening 160 and stitching 111.

The garment 100 may be made out of any suitable material depending on the application. For example, when the garment is an undergarment, the garment may be made out of any suitable textile such as cotton materials, cotton blend materials, stretch materials and the like. In other embodiments of the invention, for example, wherein the garment is a swimming trunk, the garment may be made out of other materials such as nylon, polyester and spandex materials.

The front portion 110 of the garment 100 forms a front bulging area 114 housing the genitals of the wearer which have been displaced forward and upward. As such, the garment 100 comfortably accommodates the male genitals in a manner that enhances their prominence and appearance.

As shown in FIG. 2, the outer layer of the double-layered front portion covers the total area of the front portion of the garment, as previously defined. The inner layer 116 of the double-layered front portion is folded upward along fold 140 to form a top-opening pouch 130 on the interior of the garment. The pouch 130 is held in place by stitching along the edges of the pouch 130 which are coincident with the perimeter of leg openings 160 and 170. However no stitching is used along fold 140 to secure the lower edge of pouch 130 to the outer layer of the front portion 118. However, as would be recognized by one of skill in the art, the pouch may also be formed by securing means or stitching only where pouch lip 150 is coincident with the perimeter of leg openings 160 and 170, thus leaving the sides of pouch 130 open.

The absence of stitching or other securing means along the fold 140, which forms the lower edge of pouch 130, provides flexibility and limited displaceability to the base of the pouch. This increases the comfort of the garment of the present invention as the base of the pouch can flex and move to accommodate the genitals of the wearer while displacing them forward and/or upward. Furthermore, the absence of stitching at the base of the pouch 130 decreases the manufacturing cost and complexity of the garment 100.

In the preferred embodiment shown in FIGS. 1 and 2, the pouch lip 150 includes an elastic reinforcing means, such as an elastic ribbon. The elastic reinforcing means improves the extent to which the male genitals are displaced forward and/or upward and/or improves the comfort of the garment for the wearer. However, despite the inclusion of an elastic reinforcing means in the pouch lip 150 representing a preferred embodiment, the pouch lip may also be formed of only the fabric of the garment. Furthermore, the pouch lip 150 (with or without an included elastic reinforcing means) may be of a length such that, in use, the pouch lip 150 may be pulled taut or tensioned to assist with engagement of the pouch with the genitals of the male wearer.

In use, the pouch 130 engages with the genitals of the male wearer to displace the genitals of a male wearer forward and/or upward.

In the preferred embodiment, the genitals of a male wearer may automatically engage with and be received by the pouch 130 as the garment is put on by the wearer. In one embodiment, this is effected by the engagement of the pouch lip 150 with the posterior region of the male genitals as the garment in put on by the wearer. The pouch lip 150 is preferably placed such that it engages with the posterior region of the scrotum, thus causing all of the male wearer's genitals to be received into pouch 130. However, the present invention also contemplates only the penis engaging with the pouch lip 150 and thus being received into the pouch 130. Despite the above representing preferred embodiments of the invention, the present invention also contemplates embodiments wherein the genitals are manually placed into pouch 130 by a wearer.

Those skilled in the art will appreciate that the invention described herein is susceptible to variations and modifications other than those specifically described. It is to be understood that the invention includes all such variations and modifications. The invention also includes all of the steps or features referred to, or indicated in this specification, individually or collectively, and any and all combinations of any two or more of the steps or features.

Also, it must be noted that, as used herein, the singular forms "a", "an" and "the" include plural aspects unless the context already dictates otherwise.

Finally, future patent applications may be filed in Australia or overseas on the basis of the present application, for example by claiming a divisional status and/or by claiming a continuation status.

The claims defining the invention are as follows:

1. A men's underwear or swimwear garment for supporting male genitals, the garment comprising:

a waistband;

a double-layered front portion having an inner layer and an outer layer, both extending downwards from the waistband;

a top-opening pouch formed by folding a lower portion of the inner layer of the double-layered front portion upward such that a free edge of the inner layer forms an opening at a top of the pouch, said opening being below the waistband;

a seamless and stitchless lower edge at the bottom of the pouch in the interior of the garment, said lower edge not being secured to the outer layer of the double-layered front portion, leg openings in the garment; and stitching along the side edges of the pouch so as to hold the pouch in place, said stitching being coincident with the perimeter of the leg openings, wherein the pouch engages with the genitals of a male wearer to displace the genitals of the male wearer forward and upward, wherein the front portion of the garment is shaped and/or constructed to accommodate the forwardly and upwardly displaced genitals of the male wearer, and wherein the genitals of the male wearer engage with the pouch at least by engagement of the free edge of the pouch with the posterior region of the male genitals.

2. A garment according to claim 1 wherein the garment is configured such that the genitals of the male wearer automatically engage with the pouch as the garment is put on by the wearer, without the need for manual handling of the genitals to effect engagement with the pouch.

3. A garment according to claim 1, wherein the garment is made of a material selected from the group consisting of cotton materials, cotton blend materials and stretch materials.

4. A garment according to claim 1, where the garment is made of a material selected from the group consisting of nylon, polyester and spandex.

5. A garment according to claim 1, wherein said garment is a swimming trunk.

6. A garment according to claim 1, wherein said free edge of the pouch comprises an elastic reinforcing material.

7. A garment according to claim 6, wherein said elastic reinforcing material is an elastic ribbon.

8. A garment according to claim 6, wherein said free edge is configured to be pulled taut or tensioned to assist with engagement of the pouch with the genitals of the male wearer.

9. A garment according to claim 1, wherein said free edge is configured such that it engages with the posterior region of the scrotum.

* * * * *